US005954156A

United States Patent [19]

Cooke

[11] Patent Number: 5,954,156

[45] Date of Patent: Sep. 21, 1999

[54] ADJUSTABLE SAW HORSE

[76] Inventor: John E. Cooke, 330 Washington St., Mt. Pleasant, Pa. 15666

[21] Appl. No.: 09/134,904

[22] Filed: Aug. 17, 1998

[51] Int. Cl.[6] ..... B27B 21/00

[52] U.S. Cl. ..... 182/153; 182/225

[58] Field of Search ..... 182/153, 186.2, 182/186.1, 225, 226, 111, 109

[56] References Cited

U.S. PATENT DOCUMENTS

| | | | |
|---|---|---|---|
| 926,320 | 6/1909 | Croner . | |
| 962,976 | 6/1910 | Pence et al. . | |
| 1,656,558 | 1/1928 | Dysinger | 182/186.2 |
| 1,851,668 | 3/1932 | Goodwin . | |
| 3,830,340 | 8/1974 | Schaffel | 182/226 |
| 4,565,263 | 1/1986 | Southworth . | |
| 4,782,917 | 11/1988 | Schulz . | |
| 4,804,064 | 2/1989 | Coultrop et al. . | |
| 4,877,109 | 10/1989 | Welch et al. . | |
| 5,154,255 | 10/1992 | Kiska | 182/111 |
| 5,402,860 | 4/1995 | Fry | 182/225 |

FOREIGN PATENT DOCUMENTS 758234 1/1934 France .

*Primary Examiner*—Alvin Chin-Shue
*Attorney, Agent, or Firm*—Richard C. Litman

[57] ABSTRACT

The adjustable saw horse according to the present invention has a wooden cross beam securely attached within a U-shaped aluminum channel which extends for substantially the length of the wooden cross beam. The cross beam has two supports, one at each longitudinal end of the cross beam, each support having an A-frame shape as the saw horse beam is viewed from an end. Each support consists of a pair of telescoping legs pivotally mounted to brackets on the sides of the aluminum channel, and a brace which is adjustable in length between the pair of legs. Each leg is hollow, tubular, and square in cross section. Each leg has a foot pivotally mounted thereon, the foot having a serrated edge adapted for penetrating the ground in order to firmly anchor the saw horse on sloping ground. The height of the saw horse may be adjusted between thirty-six and seventy-two inches. The saw horse is appropriate for use as a small scaffolding as well as a trestle for general carpentry work.

10 Claims, 3 Drawing Sheets

ADJUSTABLE SAW HORSE

BACKGROUND OF THE INVENTION

1. Field of the Invention

The present invention relates to trestles and support structures useful in the construction trades, and particularly to an adjustable saw horse useful in painting, carpentry, residential construction, and the like.

2. Description of the Related Art

The saw horse is a general purpose support device well known in the construction trades. A typical saw horse includes two pairs of legs with a cross beam mounted between the pairs, each pair of legs describing a generally triangular shape with the ground. At least one board may be disposed on top of a pair of saw horses, either as a work piece or as a work surface or as a small scaffolding. The portability, versatility, and economical construction of saw horses provide great utility.

It has long been noted that the convenience and functionality of the saw horse may be improved by departing from rigid structural designs. It has been found desirable to provide the saw horse with pivoting or collapsible members for convenient storage, and with some means for adjusting the height of the saw horse for various applications. It is further desirable to construct a saw horse from light weight materials to provide ease in transportation. Yet another desirable feature is some means for maintaining the saw horse in a stable and balance position on a sloping ground surface. Various modifications in the design and construction of saw horses have been proposed to accomplish these objectives.

U.S. Pat. No. 926,320, issued Jun. 27, 1909 to M. Croner teaches a saw horse with a wooden cross beam and 2 wooden uprights having a metal covering on the sides joined by two right angle brackets, diagonal braces or struts between the cross beam and the uprights, and a metal casing triangular in shape having two legs screwed to the exterior sides of the casing and a socket on the interior of the casing adapted for receiving the upright, the height of the saw horse or trestle being adjusted by sliding the uprights in the socket of the metal casing and securing the upright by a screw pressing against the metal covering of the upright.

U.S. Pat. No. 962,976, issued Jun. 28, 1910 to Pence, et al., discloses another saw horse made primarily from wood, including a cross beam and 2 vertical uprights joined by a U-shaped fitting at either end and having diagonal braces or struts between the cross beam and the uprights, two pairs of pivotally mounted supporting legs at either longitudinal end of the cross beam, cross bracing between one leg of each pair of legs on the same side of the cross beam longitudinally, braces between the legs of each pair of legs, optional leg extensions, metal sockets adapted for receiving the uprights, and a ratchet and pawl assembly connected to the socket for adjusting the height of the saw horse.

U.S. Pat. No. 1,851,668, issued Mar. 29, 1932 to P. E. Goodwin, discloses a trestle made from angle steel, each pair of legs being an integral unit generally V-shaped, two vertical standards, braces between the legs of each pair of legs, a wooden cross beam, diagonal struts between the uprights and the cross beam, and a ratchet and pawl mechanism for adjusting the height of the trestle.

U.S. Pat. No. 4,565,263, issued Jan. 21, 1986 to T. J. Southworth, describes a saw horse made from metal except for a wooden cross beam, having square, tubular, telescoping legs, triangular shaped gussets bracing the legs and cross beam longitudinally and transversely, feet consisting of circular shoes with rubber pads to frictionally engage the surface, the legs having stop plates to stop their travel in either direction and bolts extending through the legs and a hole in the stop plate to lock the telescoping legs in order to adjust the height of the saw horse.

U.S. Pat. No. 4,782,917, issued Nov. 8, 1988 to R. H. Schulz, teaches a saw horse or trestle which may be used individually, rather than in pairs, having a rectangular frame between two pairs of legs and a rectangular platform on top of the frame, with supports arms secured by clamps to adjust the height of the platform, telescoping legs secured by a bolt and wing nut to adjust the height of the legs, and a cross brace between legs on opposite sides of the platform. One edge of the rectangular frame comprises a step, and a brace between the legs comprises a second step, forming a ladder to reach the raised platform. The device can be folded and locked in the folded position.

U.S. Pat. No. 4,804,064, issued Feb. 14, 1989 to Coultrop, et al., teaches a cross beam composed of two telescoping aluminum sections locked by a resilient spring biased button, tubular telescoping legs locked by a U-shaped spring clip, the length of the legs being independently adjustable to compensate for uneven ground surfaces, and end brackets, triangular in shape, disposed between the legs and the cross beam. Each leg is attached to the end bracket by a rivet in order to rotate parallel to the cross beam for storage.

U.S. Pat. No. 4,877,109, issued Oct. 31, 1989 to Welch, et al., shows a saw horse with telescoping legs having feet parallel to the bottom of the cross beam, a brace between legs on opposing sides of the crossbeam, the legs being square and tubular in cross section, the legs being attached to a tubular support through which the cross beam slides, a rack parallel to the cross beam for holding and clamping a work piece, and, optionally, a board may be extended longitudinally supported by the leg braces to form a step.

French Patent No. 758,234, published Jan. 12, 1934, shows a trestle for scaffolding with 2 pairs of legs, each pair being pivotally mounted on a gusset which also supports a vertical tube into which supports for the cross beam telescope. The trestle includes cross bracing between the legs, and the legs fold for storage by pivoting on the gusset.

The present invention presents novel improvements in an adjustable saw horse not disclosed in the prior art. The present invention includes an aluminum channel extending between two pairs of telescoping legs, a wooden cross beam being rigidly secured within the channel. The aluminum channel lends additional support to the cross beam to withstand bending and shear stresses in order to withstand a greater load than beams which are connected in the middle, such as the Coultrop patent.

The present invention also includes a brace between adjacent legs at each end of the saw horse which is adjustable in length. This allows the separation at the base of each pair of legs to be adjusted to correspond to a lengthening or shortening of the telescoping legs, since the length of the brace may be adjusted, presenting an A-frame as viewed from the end. Prior inventions such as the Croner, Pence and Goodwin patents accomplish adjustment in the height of the saw horse by raising or lowering vertical uprights supporting the cross beam. In effect, this creates a beam supported on columns rising above the apex of the triangles formed by the pairs of supporting legs and the ground, thereby subjecting the beam to increased shear and bending stresses, and limiting the maximum height due to the risk that the base of the saw horse may become unstable and topple over. The present invention permits a greater height adjustment by broadening the base of the supporting legs while maintaining an A-frame brace between the legs.

A further feature of the present invention is the provision of pivotally mounted feet at the base of the legs of the saw horse, the feet having serrated edges adapted for penetrating the ground. Previously the only method of adjusting a saw horse to maintain a level work piece on sloping ground has been to extend the length of one or more legs, as in the Coultrop patent. While that may also be done with the present invention, the present invention also provides pivoting feet which are adapted for penetrating the ground in order to firmly anchor the saw horse on sloping ground in order to prevent the saw horse from tipping over and in order to maintain the saw horse in a firm and level position.

None of the above inventions and patents, taken either singularly or in combination, is seen to describe the improved features of the instant invention as claimed. Thus a adjustable saw horse solving the aforementioned problems is desired.

SUMMARY OF THE INVENTION

The adjustable saw horse according to the present invention has a wooden cross beam securely attached within a U-shaped aluminum channel which extends for substantially the length of the wooden cross beam. The cross beam has two supports, one at each longitudinal end of the cross beam, each support having an A-frame shape as the saw horse beam is viewed from an end. Each support consists of a pair of telescoping legs pivotally mounted to brackets on the sides of the aluminum channel, and a brace which is adjustable in length between the pair of legs. Each leg is hollow, tubular, and square in cross section. Each leg has a foot pivotally mounted thereon, the foot having a serrated edge adapted for penetrating the ground in order to firmly anchor the saw horse on sloping ground. The height of the saw horse may be adjusted between thirty-six and seventy-two inches. The saw horse is appropriate for use as a small scaffolding as well as a trestle for general carpentry work.

Accordingly, it is a principal object of the invention to provide a saw horse with an adjustable height, in which the saw horse supports at the longitudinal ends have an A-frame shape with the width of the A-frame base being adjustable in order to permit the saw horse to have greater height.

It is another object of the invention to provide a saw horse which has improved stability on sloping ground through feet pivotally mounted on the legs of the saw horse which are adapted to penetrate the ground and firmly anchor the saw horse in order to prevent the saw horse from tipping over and in order to maintain the saw horse in a firm and level position.

It is a further object of the invention to provide an adjustable saw horse with greater load bearing capacity to permit its use as a small scaffolding by providing a wooden cross beam supported longitudinally throughout its length by an aluminum channel.

Still another object of the invention is to provide an adjustable, light weight saw horse suitable for use in residential construction and general carpentry which is easy to set up and economical to manufacture.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is an adjustable saw horse, designated generally as 10 in FIGS. 1 through 6. Where dimensions are referred to in this description, it will be understood that the dimensions are furnished for the purpose of providing an enabling disclosure of a preferred embodiment according to the U.S. patent laws, and not by way of limitation. The dimensions of the adjustable saw horse 10 may vary considerably and yet be within the scope of the invention as described and claimed.

Figure 2:
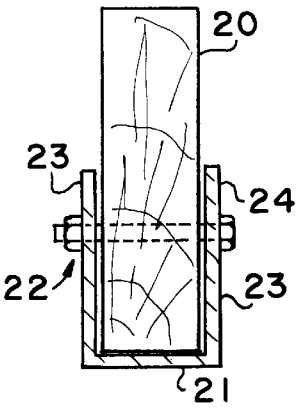
FIG. 2 is a section view drawn along lines 2—2 of FIG. 1 showing the method of attaching the wood cross beam to the channel.
Figure 1:
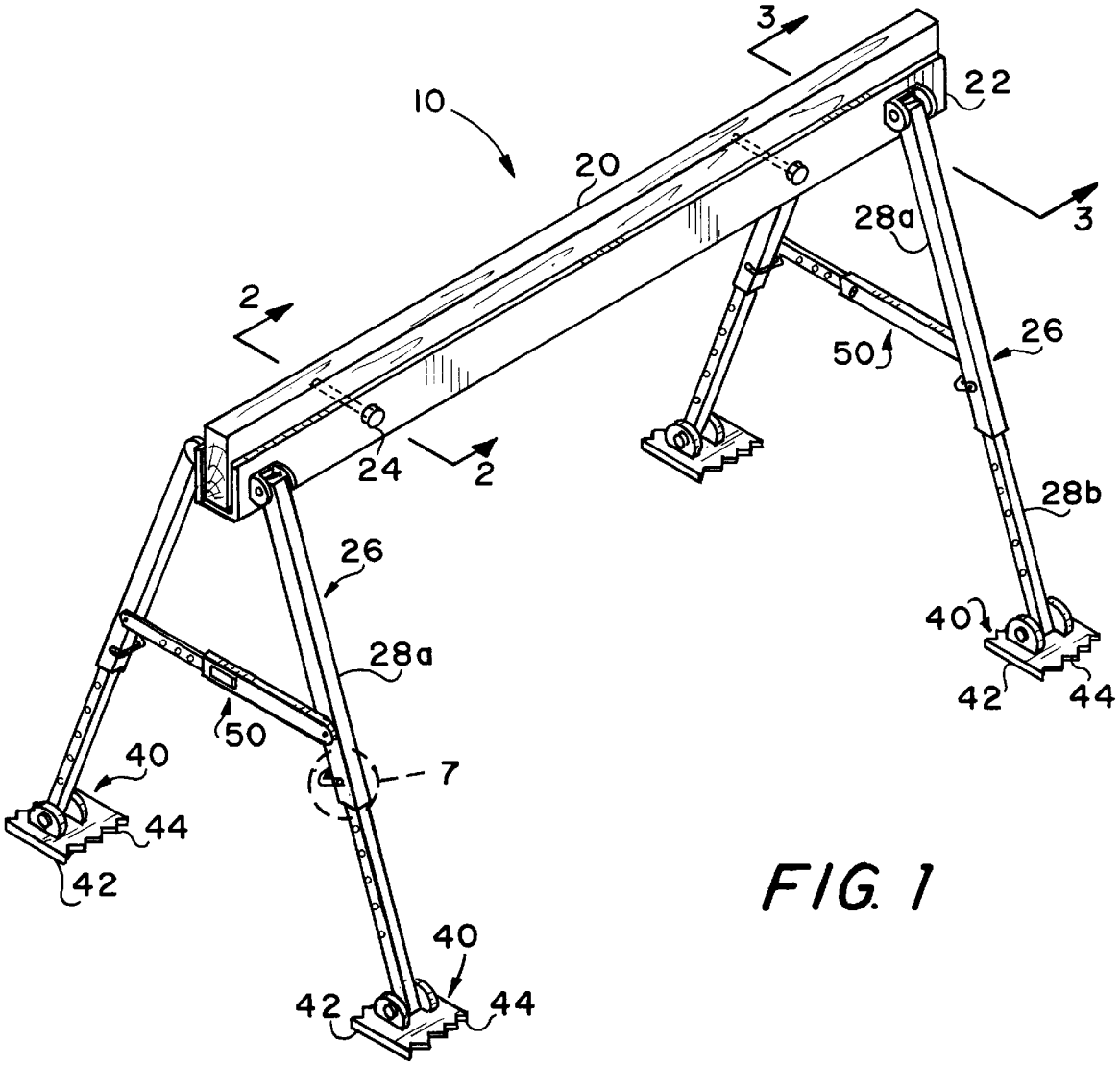
FIG. 1 is an front, perspective view of a adjustable saw horse according to the present invention.

The adjustable saw horse 10 is shown generally in FIG. 1. The saw horse includes a wooden cross beam 20 which is disposed within, and securely attached to, a U-shaped aluminum channel 22 having a bottom wall 21 and two opposing side walls 23, the channel 22 extending longitudinally for the length of the cross beam 20. The width of the cross beam 20 is greater than the height of the side walls 23 of the channel 22, so that a portion of the cross beam 20 is extends outside the channel 22. In the preferred embodiment, the internal dimensions of the channel 20 in cross section, as shown in FIG. 2, are about three inches long by one and one-half inches wide. This dimension allows a nominal size 2×6 wood beam 20 (with actual dimensions of about 1½×5½ inches) to be placed in the channel 22 with about 2½ inches of wood projecting above the channel 22 in order to protect the channel 22 from being nicked or marred by power saws and the like.

As shown in FIGS. 1 and 2, the cross beam is secured to the channel 20 by a plurality of bolts 24 or other removable means. This construction allows the cross beam 20 to be quickly and economically replaced from time to time. In the preferred embodiment, the cross beam 20 and the channel 22 are both about forty-eight inches long. The wood beam 20 has good resistance to bending stresses, but is less able to withstand shear. The aluminum channel 22 adds additional strength and stability to the cross beam 20, as well as providing a convenient frame.

Figure 3:
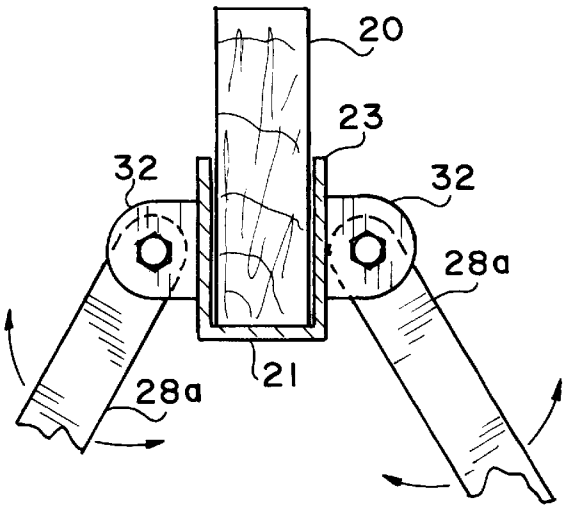
FIG. 3 is a section view drawn along lines 3—3 of FIG. 1 showing the method of pivotally attaching the legs to the channel.
Figure 4:
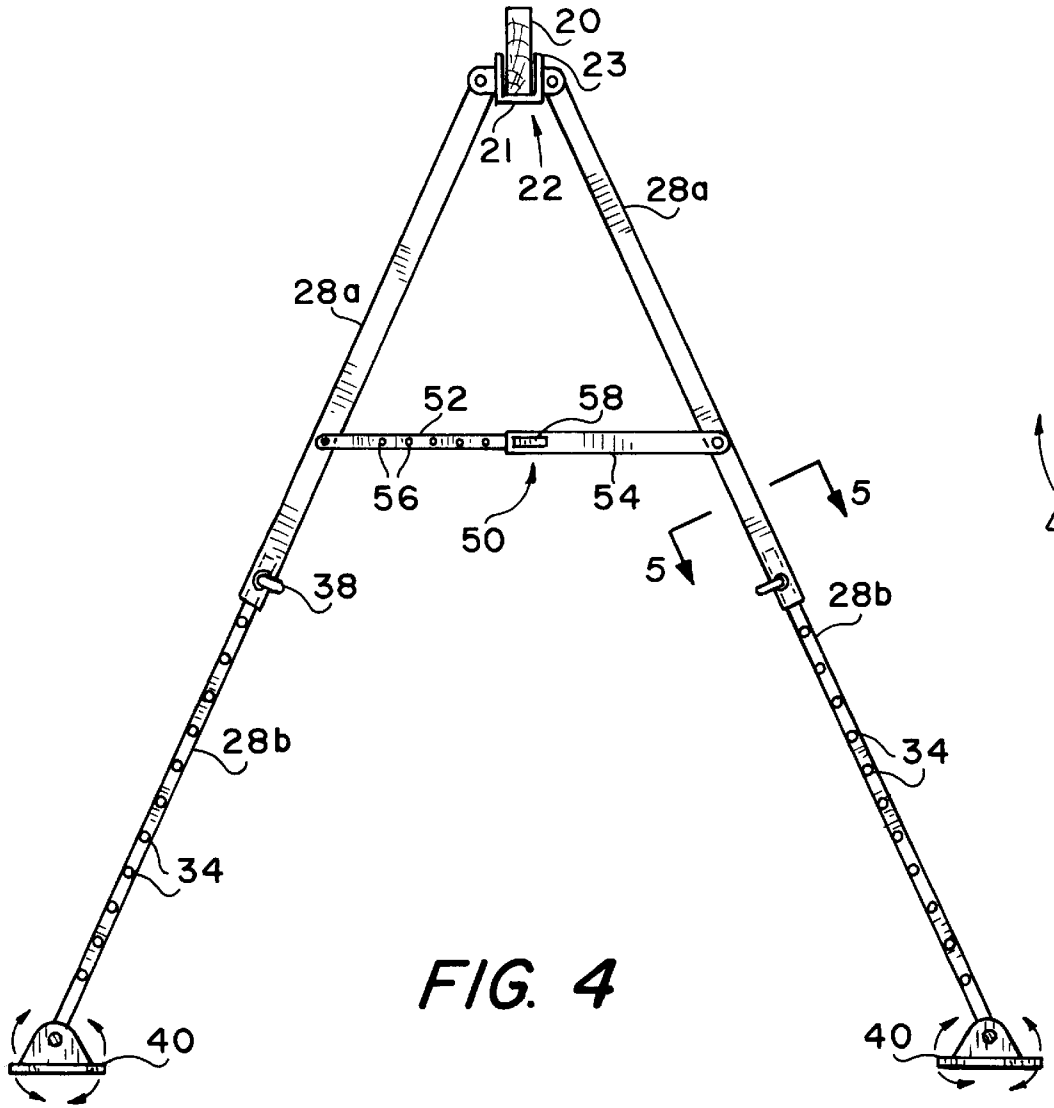
FIG. 4 is an end view of the adjustable saw horse according to the present invention.

The adjustable saw horse 10 includes a pair of supports 26, with one support 26 at each longitudinal end of the channel 22. As shown in FIG. 4, each support 26 has a pair of legs including an upper section 28 and a lower section 30, each leg having a foot 40 attached thereto, and an adjustable brace 50 connected to each leg so that each support 26 generally defines an A-frame shape. The upper section 28 of each leg is pivotally attached to the channel 22. In the preferred embodiment, this is accomplished as shown in FIG. 3, the channel 22 having a pair of brackets 32 welded to the exterior of its side walls at each longitudinal end, to which the upper section 28 of the legs are pivotally attached, e.g., by nuts and bolts.

Figure 5:
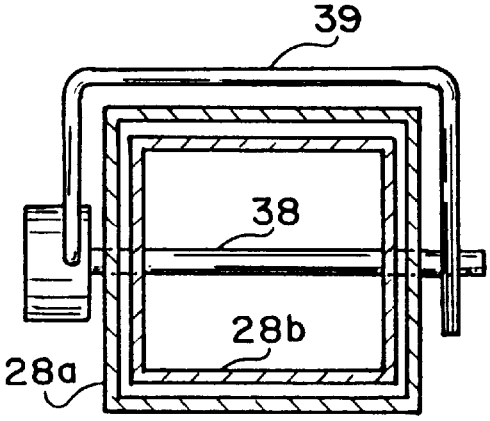
FIG. 5 is a section view drawn along lines 5—5 of FIG. 4 showing a cross section of the telescoping legs.

As shown in FIG. 5, the upper section 28 and the lower section 30 of each leg is hollow, tubular and square, the length of a side of the lower section 30 being slightly smaller than the length of a side of the upper section 28, so that the lower section 30 is slidably disposed or telescopes within the upper section 28. In the preferred embodiment the upper section 28 and lower section 30 of each leg are made from ¼" thick aluminum, the outside length of a side of the upper section 28 being about 1¾", and the outside length of a side of the lower section 30 being about 1¼". Optionally, the bottom of the upper section 28 may be fitted with a plastic sleeve covering the inside walls to reduce friction and ensure that the lower section 30 slides smoothly in the upper section 28.

Figure 7:
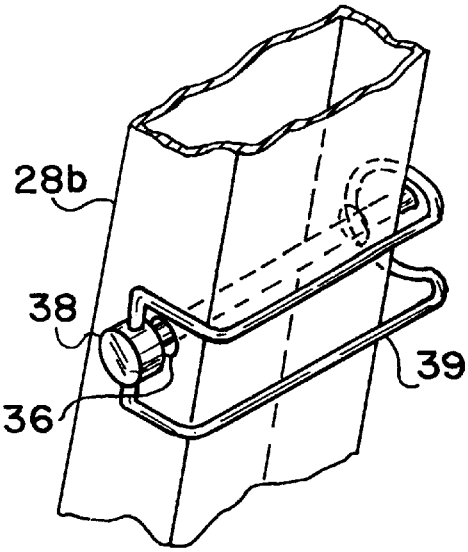
FIG. 7 is an enlarged view of the detail 7 from FIG. 1, showing the pin used to connect the sections of the telescoping legs.

The lower section 30 of each leg includes a plurality of holes 34 defined in opposing sides of the lower section 30 spaced longitudinally along the length of the lower section 30. The length of each leg may be adjusted by sliding the lower section 30 within the upper section 28 in order to register a hole 36 defined in opposing sides of the upper section 28 with one of the holes defined in the lower section 30 and inserting a pin or bolt of suitable diameter through the holes. FIGS. 4 and 5 show the upper section 28 secured to the lower section 30 by means of a pin 38, shown in greater detail in FIG. 7, having a U-shaped spring clip 39 pivotally attached to its head, the clip 39 being pivoted away from the shaft of the pin 38 as the pin is inserted through the registered holes 36 and 34 in the upper 28 and lower 30 sections, then pivoted half way about the circumference of the upper section 28 and snapped over the shaft of the pin 38. However, any appropriate means may be used, including a bolt and wing nut.

As shown in FIG. 4, the lower section 30 of each leg has a foot 40 pivotally attached thereto by any conventional means, such as a bolt and lock nut. As shown in FIG. 1, each foot 40 consists of a plate 42 having serrated edges 44 at opposite ends. The feet 40 are capable of pivoting so that the plate 42 is parallel to the bottom section 30 of the leg, a part of the plate 42 extending beyond the end of the lower section 30 of the leg and a serrated edge 44 pointing substantially vertically downwards in order to penetrate the ground, anchoring the leg 28 of the saw horse 10. This feature is particularly useful on sloping ground, enabling a board or other work surface disposed between two adjustable saw horses 10 to be maintained in a firm and level position regardless of the contour of the terrain.

Figure 6:
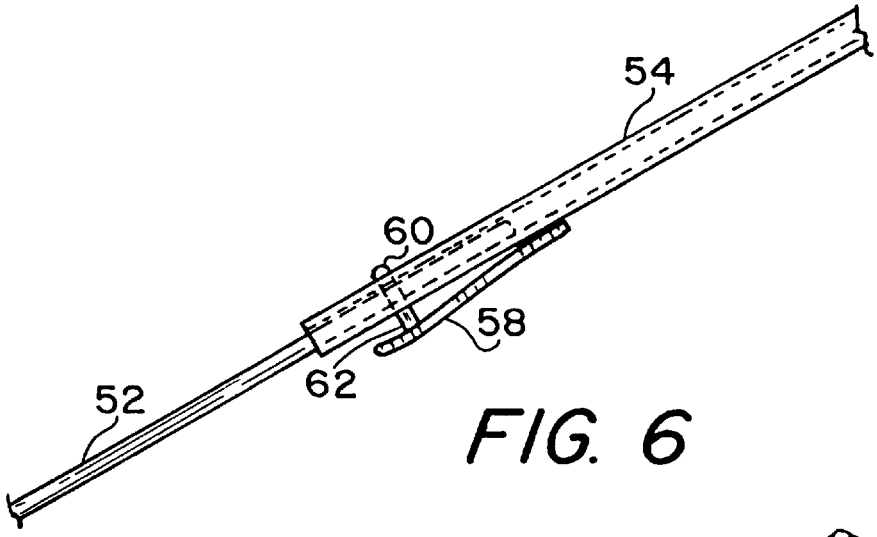
FIG. 6 is a plan view of the adjustable brace showing a method of joining the two sections of the brace.

The adjustable brace 50 is shown most clearly in FIGS. 4 and 6. The saw horse 10 includes a brace 50 in each of the supports 26 at opposite longitudinal ends of the cross beam 20. Each brace has a first section 52 mounted (by a rivet, for example) to the upper section 28 of one leg of the support 26, and a second section 54 mounted to the upper section 28 of the other leg of the support 26. The first section 52 has a plurality of holes 56 defined therein spaced longitudinally for the length of the section 52. The second section 54 has a resilient leaf spring fastener 58 pivotally attached to the second section 54, the spring 58 having a pin 60 attached to thereto. The outside perimeter of the first section 52 is slightly smaller than the inside perimeter of the second section 54 so that the first section 52 slides within the second section 54 in telescoping manner. The first section 52 has a stop means (not shown) which cooperates with the second section 54 so that the first section 52 may not be withdrawn from the second section 54. The first 52 and second 54 sections of the brace 50 are temporarily joined by registering a hole 62 defined in the second section 54 with one of the holes 56 in the first section 52 and inserting the pin 60 through the holes 62 and 56.

The adjustable brace 50 works in conjunction with the pivoting upper section 28 and telescoping lower section 30 of the supports 26 to provide a more stable base for the saw horse 10 when the height of the cross beam 20 is raised. At lower heights, a smaller angle between the upper sections 28 of the legs is acceptable, the first section 52 is telescoped farther into the second section 54 of the brace 50 so that the length of the brace 50 may be shortened. When the height of the saw horse 10 is raised by sliding the bottom sections 30 of the legs down and fastening the legs with the pins 38, it is desirable to increase the angle between the upper sections 28 in order to create a longer base between the feet 40 at each support 26 to provide more stability. This may be accomplished by adjusting the length of the brace 50, thereby preserving the A-frame shaped supports 26.

In use, the saw horse 10 is generally used in pairs. In its lowest position, generally with the cross beam 20 about thirty-six inches above ground level, the saw horse 10 is used for the full range of general carpentry, painting and other home construction uses. With the height adjusted upwards, the saw horse 10 serves as a useful trestle for the support of scaffolding in such uses as painting, installing aluminum siding to the exterior of homes, etc. Weights up to six hundred to eight hundred pounds may be supported on a pair of the adjustable saw horses 10. The upper sections 28 of the legs pivot towards a position in the same vertical plane as the cross beam 20, the lower sections 30 of the legs slide until they telescope almost entirely within the upper sections 28, and the first 52 and second 54 sections of the brace 50 collapse in telescoping manner until the upper sections 28 are separated by about one foot, all for compact storage. Construction of the saw horse 10 from aluminum, except for the cross beam 20, and the braces 50, which must be steel, preferably galvanized sheet metal, is preferred for light weight and portability, although other metals, such as steel, might be used.

It should be understood by those skilled in the art that the adjustable saw horse 10 of the present invention describes a saw horse having greater strength, greater and more stable height adjustment, and stable means for firmly anchoring the saw horse on sloping ground which is light weight, portable, and conveniently stored and transported. It will also be understood that the adjustable saw horse 10 may be used without the wooden cross beam 20, if desired.

It is to be understood that the present invention is not limited to the embodiments described above, but encompasses any and all embodiments within the scope of the following claims.

I claim:

1. An adjustable saw horse comprising:

a) a U-shaped channel, the channel being made of metal, having a bottom wall and two opposing side walls;

b) a wooden cross beam disposed within said channel, the cross beam and said channel being substantially equal in length, the width of the cross beam being greater than the height of the side walls of said channel, whereby a portion of the cross beam extends outside the channel each opposing side wall having a pair of brackets attached to the exterior of the side wall at each longitudinal end thereof, each bracket having a pair of outwardly extending ears;

c) a pair of supports, the supports being disposed at opposite longitudinal ends of said channel, each of the supports including:

i) a pair of legs, each of the legs being tubular and square in cross section, having an upper section pivotally attached on a horizontal pivot axis between a respective pair of said ears, and having a lower section;

ii) a pair of feet, said feet being pivotally attached to the lower section of said legs, each of said feet comprising a plate having serrated edges, said edges being adapted for penetrating the ground in order to anchor the legs of said saw horse; and iii) a brace disposed between said pair of legs, whereby said support has an A-shape.

2. The adjustable saw horse according to claim 1, wherein said channel and said pair of supports are made from aluminum, provided, however, that the brace of said supports is made from steel.

3. The adjustable saw horse according to claim 2, wherein:

a) the lower section of each of said legs is slidably disposed within the upper section of said leg;

b) the lower section of each of said legs has a plurality of holes defined in opposing sides of the lower section, the holes being spaced apart longitudinally along the length of the lower section;

c) the upper section of each of said legs has a hole defined in opposing sides of the upper section; and d) said legs further comprise a removable pin means for adjusting the height of said legs, said pin being adapted for insertion through the holes defined in the upper section and the lower section of said legs, the holes being registered.

4. The adjustable saw horse according to claim 3, wherein said brace further comprises a first section attached to the upper section of one of said pair of legs, and a second section attached to the upper section of the other leg of said pair of legs, wherein:

a) said first section has a plurality of holes defined therein;

b) said second section has a hole defined therein;

c) said first section is slidably disposed within said second section; and d) said second section further comprises a pin resiliently and pivotally mounted thereon, said pin being adapted for joining said first section and said second section by inserting the pin through the holes defined in said first section and said second section, the holes being registered.

5. The adjustable saw horse according to claim 4, wherein the height of the saw horse is adjustable between about thirty-six inches and seventy-two inches.

6. An adjustable saw horse comprising:

a) a U-shaped channel, the channel being made of metal, having a bottom wall and two opposing side walls, the channel being adapted to receive a wooden cross beam each opposing side wall having a pair of brackets attached to the exterior of the side wall at each longitudinal end thereof, each bracket having a pair of outwardly extending ears;

b) a pair of supports, the supports being disposed at opposite longitudinal ends of said channel, each of the supports including:

i) a pair of legs, each of the legs being tubular and square in cross section, having an upper section pivotally attached on a horizontal pivot axis between a respective pair of said ears, to said channel, and having a lower section;

ii) a pair of feet, said feet being pivotally attached to the lower section of said legs, each of said feet comprising a plate having serrated edges, said edges being adapted for penetrating the ground in order to anchor the legs of said saw horse; and iii) a brace disposed between said pair of legs, whereby said support has an A-shape.

7. The adjustable saw horse according to claim 6, wherein said channel and said pair of supports are made from aluminum, provided, however, that the brace of said supports is made from steel.

8. The adjustable saw horse according to claim 7, wherein:

a) the lower section of each of said legs is slidably disposed within the upper section of said leg;

b) the lower section of each of said legs has a plurality of holes defined in opposing sides of the lower section, the holes being spaced apart longitudinally along the length of the lower section;

c) the upper section of each of said legs has a hole defined in opposing sides of the upper section; and d) said legs further comprise a removable pin means for adjusting the height of said legs, said pin being adapted for insertion through the holes defined in the upper section and the lower section of said legs, the holes being registered.

9. The adjustable saw horse according to claim 8, wherein said brace further comprises a first section attached to the upper section of one of said pair of legs, and a second section attached to the upper section of the other leg of said pair of legs, wherein:

a) said first section has a plurality of holes defined therein;

b) said second section has a hole defined therein;

c) said first section is slidably disposed within said second section; and d) said second section further comprises a pin resiliently and pivotally mounted thereon, said pin being adapted for joining said first section and said second section by inserting the pin through the holes defined in said first section and said second section, the holes being registered.

10. The adjustable saw horse according to claim 9, wherein the height of the saw horse is adjustable between about thirty-six inches and seventy-two inches.

* * * * *